United States Patent [19]

Berwick et al.

[11] 4,284,699

[45] Aug. 18, 1981

[54] POLYESTER BINDER COMPONENT IN MULTILAYER PHOTOCONDUCTIVE ELEMENT

[75] Inventors: Martin A. Berwick, Kendall; Edgar E. Riecke, Webster, both of N.Y.

[73] Assignee: Eastman Kodak Company, Rochester, N.Y.

[21] Appl. No.: 910,399

[22] Filed: May 30, 1978

Related U.S. Application Data

[63] Continuation-in-part of Ser. No. 768,460, Feb. 14, 1977, Pat. No. 4,173,472, which is a continuation-in-part of Ser. No. 696,248, Jun. 15, 1976, abandoned.

[51] Int. Cl.[3] ..... G03G 5/05; G03G 5/10

[52] U.S. Cl. ..... 430/96; 430/58; 430/908

[58] Field of Search ..... 96/1.5, 1.6, 908; 430/66, 96, 58

[56] References Cited

U.S. PATENT DOCUMENTS

| | | | |
|---|---|---|---|
| 3,378,370 | 4/1968 | Brancato | 430/87 |
| 3,438,773 | 4/1969 | Hayashi et al. | 430/60 |
| 3,640,708 | 2/1972 | Humphriss et al. | 430/66 |
| 3,647,432 | 3/1972 | Holstead | 430/66 |
| 3,658,541 | 4/1972 | Jacoby | 430/155 |
| 3,725,329 | 4/1973 | Jacoby et al. | 260/32.8 R |
| 3,745,005 | 7/1973 | Yoerger et al. | 430/66 |
| 3,765,884 | 10/1973 | Shea | 430/66 |
| 3,775,152 | 11/1973 | Jacoby et al. | 430/155 |
| 3,865,869 | 2/1975 | Kuehn et al. | 430/66 |
| 3,932,179 | 1/1976 | Perez-Albuerne | 96/1.5 |

FOREIGN PATENT DOCUMENTS

| | | | |
|---|---|---|---|
| 792846 | 8/1968 | Canada | 260/32.8 R |
| 799555 | 11/1968 | Canada | 430/155 |
| 1356004 | 6/1974 | United Kingdom | 430/155 |
| 1431415 | 4/1976 | United Kingdom | 430/75 |

OTHER PUBLICATIONS

Polyester Plasticizer for Films of Poly(N-vinyl carbazole) Xerox Disclosure Journal vol. #1, 1976, p. 31.

*Primary Examiner*—Roland E. Martin, Jr.
*Assistant Examiner*—John L. Goodrow
*Attorney, Agent, or Firm*—Torger N. Dahl

[57] ABSTRACT

A multilayer photoconductive element containing a photoconductive insulating composition and a conducting layer, such element having in association with the photoconductive composition an amorphous, water-insoluble polyester selected from the group consisting of (a) polyesters prepared from units derived from at least one aromatic dicarboxylic acid component and at least one diol component, at least one of said acid or diol components being a non-linear monomer selected from the group consisting of an isophthalic acid component or a branched-chain alkylene diol having the formula $$HO—CH_2—R^1—CH_2—OH$$

wherein $R^1$ is a branched-chain alkylene group, and (b) polyester copolymers prepared from units derived from at least one aromatic dicarboxylic acid component and at least one diol component, at least one of said acid or said diol components being a mixture of at least two different acids or two different diols, respectively, so that a copolymer is obtained, and at least one of said acid or one of said diol components being selected from the group consisting of a non-linear monomer as defined above or a cycloaliphatic diol; with the proviso that said photoconductive insulating composition contains a minor amount of said polyester.

12 Claims, No Drawings

POLYESTER BINDER COMPONENT IN MULTILAYER PHOTOCONDUCTIVE ELEMENT

This application is a continuation-in-part application of U.S. Patent Application Ser. No. 768,460, filed Feb. 14, 1977 now U.S. Pat. No. 4,173,472, which is a continuation-in-part application of U.S. Pat. Application Ser. No. 696,248 filed June 15, 1976, now abandoned.

FIELD OF THE INVENTION

This invention relates in general to electrophotography and in particular to unitary multilayer electrophotographic elements which include an electrically conductive layer and a photoconductive insulating layer.

BACKGROUND OF THE INVENTION

Electrophotographic imaging processes and techniques have been extensively described in both the patent and other literature. Generally, these processes have in common the steps of employing an electrophotographic element which is prepared to respond to imagewise exposure with electromagnetic radiation by forming a latent electrostatic charge image. A variety of subsequent operations, now well-known in the art, can then be employed to produce a record of the image.

One type of unitary photoconductive element particularly useful in electrophotography is generally produced in a multilayer structure. Such an element is prepared, for example, by coating one or more layers of an insulating photoconductive composition onto a support which previously has been overcoated with a layer of electrically conducting material. In addition, a polymeric interlayer is often interposed between the conducting material and photoconductive composition of such unitary multilayer elements to provide adhesion and/or to serve as an electrical barrier layer between the conducting material and the photoconductive composition.

Representative publications which disclose various polymeric materials which may be employed as interlayers for use in a unitary multilayer element of the type described immediately hereinabove are set forth, for example, in U.S. Pat. No. 3,640,708 issued Feb. 8, 1972, U.S. Pat. No. 3,438,773, issued Apr. 15, 1969; U.S. Pat. No. 3,745,005 issued July 10, 1973; and U.S. Pat. No. 3,932,179 issued Jan. 13, 1976.

As indicated in the above patent publications, one particularly useful component in such polymeric interlayers is a copolymer such as a terpolymer of tetrapolymer which is hydrophobic and which has a substantial number of repeating units derived from a carboxylic acid group such as itaconic acid, acrylic acid, and the like, and/or a substantial number of repeating units derived from vinylidene chloride. Although hydrophobic terpolymers and tetrapolymers prepared containing the above-described repeating units have been found to provide good adhesive properties for use in a unitary multilayer photoconductive element as described hereinabove, it has recently been determined that these hydrophobic terpolymer and tetrapolymer materials can seriously interfere with the electrical characteristics and operating properties of multilayer photoconductive layers. In particular, it has been found that the above-described polymeric materials which contain acid components, such as itaconic or acrylic acid, or units derived from a monomer such as vinylidene chloride which is subject to degradation to form an acid (i.e., hydrochloric acid), can seriously impair the electrical characteristics of the photoconductive composition associated with said multilayer photoconductive element.

In addition to the foregoing patent publications, other patent publications such as U.S. Pat. No. 3,647,432 issued Mar. 7, 1972 and U.S. Pat. No. 3,765,884 issued Oct. 16, 1973 have described compositions composed of certain organic photoconductor or sensitizer materials admixed with any one of various binder materials. Included within the extensive listing of useful such binder materials are polycondensate polymers such as a polyester of ethylene glycol, neopentyl glycol, terephthalic acid and isophthalic acid. Although the aforementioned polyester can be employed as the binder material of a photoconductive insulating composition, it has been found that this polyester when present as the sole binder component of, for example, certain homogeneous organic photoconductive insulating compositions, can interfere with the electrical operation of the resultant photoconductive composition such that it is incapable of readily accepting an initial electrostatic charge of a magnitude within the desired operating ranges of such photoconductive compositions, i.e., 600 volts or more.

SUMMARY OF THE INVENTION

In accord with the improved multilayer photoconductive element of the present invention wherein a photoconductive insulating composition comprising a photoconductive material admixed in an electrically insulating polymeric binder(s) is in electrical contact with an electrically conducting layer, there is provided, in association with said photoconductive composition, certain polyester materials as defined hereinbelow.

The polyester materials employed in the improved multilayer photoconductive elements of the invention are amorphous, water-insoluble polyesters selected from the group consisting of (a) polyesters prepared from units derived from at least one aromatic dicarboxylic acid component and at least one diol component, at least one of said acid or diol components being a non-linear monomer selected from the group consisting of an isophthalic acid component or a branched-chain alkylene diol having the formula $$\text{I. } HO{-}CH_2{-}R^1{-}CH_2{-}OH$$

wherein $R^1$ is a branched-chain alkylene group, and (b) polyester copolymers prepared from units derived from at least one aromatic dicarboxylic acid component and at least one diol component, at least one of said acid or said diol components being a mixture of at least two different acids or two different diols, respectively, so that a polyester copolymer (i.e., a copolyester) is obtained, and at least one of said acid or one of said diol components being selected from the group consisting of a non-linear monomer as defined above or a cycloaliphatic diol.

In accord with the invention, the polyester employed herein is contained in minor amounts in said photoconductive insulating composition to form together with the other polymeric binder(s) mentioned hereinabove, an optically homogeneous mixture of binders in said photoconductive insulating composition. The polyester always constitutes a minor amount of the total dry weight of all binders contained in the photoconductive insulating composition.

DESCRIPTION OF THE PREFERRED EMBODIMENTS

The aromatic dicarboxylic acid component used to prepare the polyesters employed in the invention is isophthalic or terephthalic acid or the polyesterifiable derivatives thereof including the corresponding esters derived from said acids, for example, diethylisophthalate and dimethylterephthalate and their corresponding acid anhydrides and acid chlorides. A particularly useful dicarboxylic acid component employed in the invention is terephthalic acid and polyesterfiable derivatives thereof. If desired, the dicarboxylic acid component used in the present invention may comprise a mixture of the foregoing dicarboxylic acid materials.

Typically, the branched-chain alkylene diol component represented by structural formula I hereinabove contains a branched-chain alkylene group ($R^1$ in formula I above) having from 2 to about 15 carbon atoms, preferably from 3 to 7 carbon atoms. Examples of suitable branched-chain alkylene groups include isoalkylidene groups such as isopropylidene, and isobutylidene, branched-chain pentylene and branched-chain hexylene, though isopropylidene is preferred. The alkylene groups are attached to the diol to form symmetrical or unsymmetrical side chains. Neo-alkylene groups are generally preferred, i.e. those having at least one carbon atom connected directly with four other carbon atoms, e.g. neopentylene (2,2-dimethyl-1,3-trimethylene). Examples of suitable diols containing both types of side chains include 2,2-diethyl-1,3-propanediol; 2,2-dimethyl-1,3-propanediol (neopentyl glycol); 2-methyl-2-ethyl-1,3-propanediol; 3,3-dimethyl-1,5-pentanediol and 3,3-diethyl-1,5-pentane diol.

The term "non-linear monomer" as used in the present specification is defined to include the non-linear aromatic dicarboxylic acid isophthalic acid as well as polyesterifiable derivatives thereof and the above-described branched-chain alkylene diol materials having formula I above. These materials are included in the class (a) polyesters noted above to obtain desirable amorphous and organic solvent solubility properties in these polyesters.

In the class (b) polyesters described hereinabove the desired solubility and amorphous character are obtained by virtue of employing polyester copolymers (sometimes referred to as "copolyesters" or "mixed polyesters") and by incorporating one or more non-linear monomers as defined above or a cycloaliphatic diol.

Representative cycloaliphatic diols typically have the structure $$\text{III. } HO{-}CH_2{-}R^2{-}CH_2{-}OH$$

wherein $R^2$ is a cycloaliphatic group. Suitable cycloaliphatic groups include those containing from 4 to about 12 carbon atoms, and preferably 4 to about 6 carbon atoms. Examples of suitable cycloaliphatic groups include cyclobutylene. cyclopentylene, cyclohexylene, cycloheptylene, cyclooctylene and cyclodecylene, with cyclohexylene being preferred.

It will be appreciated that, in accord with the present invention, one or more of the above-described cycloaliphatic diols may be employed, not only in the class (b) polyesters described above, but also as a diol component of the above-described class (a) polyesters.

In addition to the above-described components, the class (a) and class (b) polyesters used in the present invention may also contain any one of various straight-chain alkylene diol materials and/or any one of various aromatic diols including bisphenols or monocyclic aromatic diols. Representative straight-chain alkylene diol components useful in preparing the polyesters employed in the present invention typically have the formula $$\text{IV. } HO{-}CH_2{-}R^3{-}OH$$

wherein $R^3$ represents a straight-chain alkylene group having from 1 to about 10 carbon atoms, preferably from 1 to about 4 carbon atoms. A partial listing of representative such straight-chain alkylene diols include ethylene glycol, trimethylenediol, tetramethylene glycol, pentamethylene glycol, and the like.

Representative bisphenols which may be employed are generally of the structure of formula II:

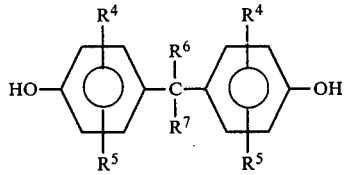

II.

wherein each $R^4$ and $R^5$, which can be the same or different, are selected from the group consisting of hydrogen atoms, aryl radicals, such as phenyl, including substituted phenyl, halogen atoms, nitro radicals, cyano radicals, alkoxy radicals and the like, and wherein the substituents on the phenyl radical may be a halogen atom, nitro radical, cyano radical, or alkoxy radical. $R^6$ and $R^7$ represent aliphatic, monocyclic or bicyclic radicals and can each be hydrogen atoms; alkyl radicals of from 1 to 6 carbon atoms, including substituted alkyl radicals, such as fluoromethyl, difluoromethyl, trifluoromethyl, dichlorofluoromethyl, 2-[2,3,4,5-tetrahydro-2,2,-dimethyl-4-oxofur-3-yl]ethyl and the like; cycloalkyl radicals of from 4 to 6 carbon atoms, such as cyclohexyl; and aromatic radicals having from 6 to 20 carbon atoms, such as phenyl, 3,4-dichlorophenyl, 2,4-dichlorophenyl. $R^6$ and $R^7$ taken together with the carbon atoms to which they are attached can represent a monocyclic, bicyclic, or heterocyclic moiety having from 4 to about 10 atoms in the ring.

Typical useful bisphenols include: Bisphenol A; 2,2-bis(4-hydroxy-3,5-dichlorophenyl)propane[tetrachlorobisphenol A]; 1-phenyl-1,1-bis(4-hydroxyphenyl)ethane; 1-(3,4-dichlorophenyl)-1,1-bis(4-hydroxyphenyl)ethane; 2,2-bis(4-hydroxyphenyl)-4-[3-(2,3,4,5-tetrahydro-2,2-dimethyl-4-oxofuryl)butane]; bis(4-hydroxyphenyl)methane; 2,4-di-chlorophenyl-bis(4-hydroxyphenyl)methane; 1,1-bis(4-hydroxyphenyl)cyclohexane, 1,1,1,3,3,3-hexafluoro-2,2-bis(4-hydroxyphenyl)propane; diphenyl-bis(4-hydroxyphenyl)methane.

Other useful bisphenols include 1,4-naphthalenediol, 2,5-naphthalenediol, bis(4-hydroxy-2-methyl-3-propylphenyl)methane, 1,1-bis(2-ethyl-4-hydroxy-5-sec.-butylphenyl)ethane, 2,2-bis(4-hydroxyphenyl)propane, 2,2-bis(4-hydroxy-2-methyl-5-tert.-butylphenyl)propane, 1,1-bis(4-hydroxy-2-methyl-5-isooctylphenyl-)isobutane, bis-(2-ethyl-4-hydroxyphenyl)-4,4-di-p-tolylmethane. Still other useful bisphenols are disclosed in U.S. Pat. No. 3,030,335 and Canadian Pat. No. 576,491.

Representative monocyclic aromatic diols include hydroquinone and hydroquinones substituted with alkyl groups of 1 to about 15 carbon atoms, or halogen atoms, resorcinol, unsubstituted or substituted with lower alkyl groups or halogen atoms, and the like.

The polyesters employed in the present invention should be completely esterified so that there is little or no remaining carboxylic acid groups associated with said aromatic dicarboxylic acid component used in preparing the polyesters. One advantage of the multilayer photoconductive elements of the present invention is that these elements employ the above-described polyesters which are completely or at least substantially free of any acid functions. The presence of such acid function has been found to seriously interfere with the electrical properties of many useful photoconductive compositions, particularly organic photoconductive compositions. Although the precise reason(s) for this is not fully understood, it is believed that such acid functions can interact with, for example, organic photoconductive materials, resulting in impaired electrical performance such as electrical fatigue of the photoconductive material.

In accord with one embodiment of the invention, a preferred class (b) polyester is a copolyester which contains repeating units represented by each of the following structural formulas V, VI, and VII:

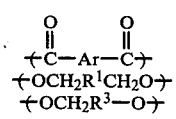

V.

VI.

VII.

wherein Ar represents an appropriate aromatic moiety and $R^1$ and $R^3$ are as defined above.

As noted above the polyester materials employed in the present invention are amorphous, i.e., they are polymers which show no melting point transition and no definite X-ray diffraction pattern. In addition, the class (b) polyesters are random copolymers. The polyesters employed in the invention exhibit good film-forming properties and freedom from crystallinity.

Because it is desirable to employ completely esterified polyesters in the present invention, it will be appreciated that these materials are prepared using approximately equal mole amounts of the dicarboxylic acid component and alkylene glycol components. In fact, it is usual to employ a slight excess of the glycol components to assure complete esterification; or, in the alternative, to employ various purification or separation techniques subsequent to the process used for production of the desired polyester so that one can be assured of obtaining a resultant polyester which is substantially or completely esterified.

When more than one diol or more than one aromatic dicarboxylic acid component are used in preparing the polyesters employed in the invention, it will be appreciated that the specific amount of each such diol or acid may vary so long as the total amount of diol and acid components are within the above-noted range, i.e., approximately equal molar amounts of acid and diol components. The exact amount of each individual diol or acid can vary widely depending on the specific material under consideration and its properties. In general, one can readily optimize a particular combination of diol and acid components to achieve the desired polymer properties, e.g., organic solvent soluble, film-forming, optically transparent, and etc.

In general, preferred polyesters employed in the present invention are characterized by an inherent viscosity greater than about 0.4 so that optimum physical properties are obtained and by their solubility in conventional organic solvents such as chlorinated hydrocarbon solvents, for example methylene chloride, chloroform, dichloroethane, mixtures thereof and the like. As noted above, the polyesters employed in the present invention are water-insoluble. Inherent viscosity of these polyesters is measured in a solution composed of a 1:1 weight ratio of phenol and chlorobenzene at 25° C. using a 0.5 weight percent polyester concentration.

The specific polyesters employed in the present invention represent known materials and therefore detailed discussion of various methods of their preparation are unnecessary herein. For further detail concerning their preparation, reference may be made to Example 1 hereinafter and to the following patent publications hereby incorporated by reference: British Pat. No. 1,356,004 published June 12, 1974 and Canadian Pat. Nos. 792,846 and 799,555.

As set forth above, the polyesters employed in the present invention are associated with the photoconductive insulating composition of the resultant multilayer photoconductive element, as an actual component of the photoconductive composition and in a minor amount based on the total amount of polymeric binder contained in said photoconductive composition. Accordingly, the polyester used in the present invention typically represents from about 1 to less than 50 percent by weight of the total amount of polymeric binder present in said photoconductive composition. In accord with certain preferred embodiments of the present invention, the polyesters, when incorporated in the photoconductive insulating composition, represent from about 2 to about 20 percent by weight of the total amount of polymeric binder present in said photoconductive composition. In general, the total amount of polyester component contained in a typical photoconductive composition employed in the multilayer elements of the present invention is within the range of from about 1.0 to about 40 weight percent based on the total dry weight of all components of the photoconductive composition. As used herein, the term "percent by weight" represents a weight percent amount based on the dry weight of the particular composition under consideration, thus excluding any amount of liquid coating vehicle which may be used in a conventional coating dope.

As previously mentioned, a polyester of the invention forms, together with the other polymeric binder components contained in the photoconductive insulating composition, an optically homogeneous mixture of binders. As used herein, the phrase "optically homogeneous mixture of binders" means a mixture of binders which, when viewed by the naked human eye, exhibits no greater degree of light scattering (sometimes referred to as "haze") than any one of the binders exhibits by itself. This means that a mixture of binders useful in the practice of the invention comprises polyesters and other polymeric binders that are compatible with each other, i.e., can form a solid solution with each other, thus causing no increase in light scattering. Increased light scattering is undesirable in photoconductive compositions of the invention, because such compositions provide resultant visible images which exhibit a lower degree of resolution than they would if the degree of light scattering were less.

As suggested, the polyesters employed in the present invention have found particular utility as a minor component of organic photoconductive compositions. The incorporation of a minor amount of such a polyester into the organic photoconductive composition results in no discernible deleterious effect on the electrical operating characteristics of the resultant composition. In addition, the class (b) copolymers of the invention have been found to impart improved adhesion to organic photoconductive compositions in which they are incorporated in comparison to that exhibited by somewhat similar polyesters such as a polyester of terephthalic acid; 2,5-dichloroterephthalic acid; and ethylene glycol or a polyester of terephthalic acid; 2,2-bis([4-(β-hydroxyethoxy)phenyl]propane and ethylene glycol.

Suitable conducting layer materials useful in the elements of the present invention include any of a wide variety of electrical conducting supports, for example, paper (at a relative humidity above 20 percent); aluminumpaper laminates; metal foils, such as aluminum foil, zinc foil, etc.; metal plates, such as aluminum, copper, zinc, brass and galvanized plates; vacuum deposited metal layers, such as silver, nickel, chromium, aluminum and the like coated on paper or conventional photographic film base such as cellulose acetate, polystyrene, poly(ethylene-terephthalate), etc. Such conducting materials as nickel can be vacuum deposited on transparent film supports in sufficiently thin layers to allow electrophotographic layers prepared therefrom to be exposed through the transparent film support if so desired. An especially useful conducting support can be prepared by coating a support material such as poly(ethylene-terephthalate), with a conducting layer containing semiconductors dispersed in a resin. Such conducting layers both with and without electrical barrier layers are described in U.S. Pat. No. 3,245,833 by Trevoy issued Apr. 12, 1966 and Dessauer, U.S. Pat. No. 2,901,348 issued Aug. 25, 1959. Other useful conducting layers include compositions consisting essentially of an intimate mixture of at least one protective inorganic oxide and from about 30 to about 70 percent by weight of at least one conducting metal, e.g., a vacuum-deposited cermet conducting layer as described in Rasch, U.S. Pat. No. 3,880,657, issued Apr. 29, 1975. Likewise, a suitable conducting coating can be prepared from the sodium salt of a carboxyester lactone of maleic anhydride and a vinylacetate polymer. Such kinds of conducting layers and methods for their preparation and use are disclosed in U.S. Pat. No. 3,007,901 by Minsk issued Nov. 7, 1961 and U.S. Pat. No. 3,262,807 by Sterman et al issued July 26, 1966. Likewise, a suitable conducting coating can be prepared from the sodium salt of a carboxyester lactone of maleic anhydride and a vinylacetate polymer. Such kinds of conducting layers and methods for their optimum preparation and use are disclosed in U.S. Pat. No. 3,007,901 by Minsk issued Nov. 7, 1961 and U.S. Pat. No. 3,262,807 by Sterman et al issued July 26, 1966.

The photoconductive insulating composition employed in the multilayer elements of the present invention may be composed of a wide variety of organic, including organo-metallic, or inorganic photoconductive materials in admixture with an electrically insulating, film-forming binder material. Optically, various sensitizing materials such as spectral sensitizing dyes and chemical sensitizers may also be incorporated therein. In general, typical photoconductive compositions employed in the present invention contain an amount of photoconductor equal to at least about 1 weight percent based on the total dry weight of the photoconductive composition and, preferably, at least about 15% by weight based on the total weight of the photoconductive composition. The upper limit in the amount of photoconductive material present in a particular photoconductive compositions can be widely varied depending upon the sensitivity of the specific photoconductor under consideration, its compatibility with a particular mixture of binders, and the like. Typically, the mixture of binders is present in the photoconductive compositions employed in the invention in an amount within the range of from about 85 to about 10% by weight based on the total dry weight of the photoconductive composition.

As indicated, a wide variety of different photoconductors, including inorganic, organic, including metallo-organic and organic polymeric photoconductors, may be used in the photoconductive compositions employed in the present invention. A variety of such materials are well known in the art and an extended list thereof is considered unnecessary herein. Such materials include, for example, zinc oxide, lead oxide, selenium, various particulate organic pigment materials such as phthalocyanine pigments, and a wide variety of well-known organic compounds including metallo-organic and polymeric organic photoconductors. A partial listing of representative such photoconductive materials may be found, for example, in *Research Disclosure,* Vol. 109, May 1973, page 61, in an article entitled "Electrophotographic Elements, Materials and Processes," at paragraph IV(A) thereof. This partial listing of well-known photoconductive materials is hereby incorporated by reference.

In general, the photoconductive compositions employed in the element of the present invention may be prepared in the usual manner, i.e., by blending a dispersion or solution of the photoconductive material together with a mixture of binders and coating or otherwise forming a layer of such photoconductive composition on an underlying conducting layer.

As indicated, various photoconductive compositions employed in the invention can be sensitized by the addition of amounts of sensitizing compounds effective to provide improved electrophotosensitivity. Sensitizing compounds useful in various photoconductive compositions can be selected from a wide variety of such materials, including various pyrylium dye salts such as pyrylium, bispyrylium, thiapyrylium, and selenapyrylium dye salts as disclosed in VanAllan et al U.S. Pat. No. 3,250,615; fluorenes, such as 7,12-dioxo-13-dibenzo(a,h) fluorene and the like; aromatic nitro compounds of the kind described in U.S. Pat. No. 2,610,120; anthrones like those disclosed in U.S. Pat. No. 2,670,286; benzophenones, such as described in U.S. Pat. No. 2,670,287; thiazoles, such as described in U.S. Pat. No. 3,732,301; various dyes such as cyanine (including carbocyanine), merocyanine, diarylmethane, thiazine, azine, oxazine, xanthene, phthalein, acridine, azo anthraquinone dyes, and the like and mixtures thereof.

Where a sensitizing compound is employed in a photoconductive composition used in the present invention, it is a normal practice to mix a suitable amount of a sensitizing compound with the coating composition so that, after thorough mixing, the sensitizing compound is uniformly distributed in the coated layer.

Other methods of incorporating a sensitizing compound or the effects thereof may, however, be employed consistent with the practice of the invention. Of course, in preparing the photoconductive compositions used in the present invention, no sensitizing is required in such layers where the particular photoconductors employed exhibit sufficient photosensitivity in the desired regions of the spectrum without use of a sensitizer. In general, although the optimum concentration in any given case will vary depending on the specific photoconductor and sensitizing compound selected, substantial speed gains can usually be obtained wherein appropriate sensitizing compound is added in a concentration within the range of from about 0.001 to about 30% by weight based on the dry weight of the photoconductive insulating composition, preferably an amount within the range of from about 0.005 to about 10% by weight based on the dry weight of the photoconductive insulating composition.

With respect to the various other binder materials which may be employed in the photosensitive compositions used in the present invention by forming an optically homogeneous mixture with the polyesters described previously, preferred binders are film-forming, hydrophobic polymeric materials having fairly high dielectric strength and good electrically insulating properties.

Typical of these materials are the following:

I. Natural resins including gelatin, cellulose ester derivatives such as alkyl esters of carboxylated cellulose, hydroxy ethyl cellulose, carboxy methyl cellulose, carboxy methyl hydroxy ethyl cellulose, etc.;

II. Vinyl resins including
   a. polyvinyl esters such as vinyl acetate resin, a copolymer of vinyl acetate with an ester of vinyl alcohol and a higher aliphatic carboxylic acid such as lauric acid or stearic acid, polyvinyl stearate, a poly(vinylhaloarylate) such as poly(vinyl-m-bromobenzoate-covinyl acetate), a terpolymer of vinyl butyral with vinyl alcohol and vinyl acetate, etc.;
   b. styrene polymers such as polystyrene, a nitrated polystyrene, a copolymer of styrene and monoisobutyl maleate, a copolymer of styrene and butadiene, a copolymer of dimethylitaconate and styrene, polymethylstyrene, etc.;
   c. methacrylic acid ester polymers such as a poly(alkylmethacrylate), etc.;
   d. polyolefins such as chlorinated polyethylene, chlorinated polypropylene, poly(isobutylene), etc.;
   e. poly(vinyl acetals) such as poly(vinyl butyral), etc.; and
   f. poly(vinyl alcohol);

III. Polycondensates including
   a. a polyester of 1,3-disulfobenzene and 2,2-bis(4-hydroxyphenyl)propane;
   b. a polyester of diphenyl-p,p'-disulphonic acid and 2,2-bis(4-hydroxyphenyl)propane;
   c. a polyester of 4,4'-dicarboxyphenyl ether and 2,2-bis(4-hydroxyphenyl)propane;
   d. a polyester of 2,2-bis(4-hydroxyphenyl)propane and fumaric acid;
   e. a polyester of phosphoric acid and hydroquinone;
   f. polycarbonates (including polythiocarbonates) such as the polycarbonate of 2,2-bis(4-hydroxyphenyl)propane;
   g. polyamides;
   h. ketone resins; and
   i. phenol-formaldehyde resins;

IV. Silicone resins;

V. Alkyd resins including styrene-alkyd resins, silicone-alkyd resins, soya-alkyd resins, etc.;

VI. Paraffin; and

VII. Mineral waxes.

Various coating vehicles for preparing photoconductive compositions useful in the present invention include a variety of well-known solvent materials. Typically, volatile organic solvents have been found quite effective. Representative such solvents include: (1) aromatic hydrocarbons such as benzene, including substituted aromatic hydrocarbons such as toluene, xylene, mesitylene, etc.; ketones such as acetone, 2-butanone, etc.; halogenated aliphatic hydrocarbons such as methylene chloride, chloroform, ethylene chloride; ethers including cyclic ethers such as tetrahydrofuran, ethylether; and mixtures of the foregoing.

In accord with one especially preferred embodiment of the present invention, the photoconductive insulating composition contained in the photoconductive element of the invention is a homogeneous organic photoconductive composition containing an electrically insulating film-forming polymeric binder and an organic photoconductor(s) in solid solution in said binder. Optionally, one or more sensitizing compounds, such as one of the above-described pyrylium, bispyrylium, thiapyrylium or selenapyrylium materials may also be incorporated therein. Such photoconductive compositions are readily coated from organic solvents and when used with appropriate sensitizing compounds exhibit very useful ranges of photosensitivity. In addition, such compositions because of their optical homogeneity provide resultant visible images which exhibit a high degree of resolution. Among the various organic photoconductive materials which may be incorporated in such homogeneous compositions are any of the various organic photoconductive materials set forth in the above-referenced *Research Disclosure* article in paragraphs IV(A)(2) through IV(A)(12). Especially useful such photoconductive materials include p-type organic photoconductors having in the molecular structure thereof one or more of the following organic groups typically referred to in the art as arylamine groups and polyarylalkane groups, respectively. Still another group of useful such p-type organic photoconductive materials useful in the photoconductive compositions employed in the present invention are various pyrrole organic photoconductors such as those described in U.S. Pat. No. 3,174,854 issued March 1965 and U.S. Pat. No. 3,485,625 issued Dec. 23, 1969.

A partial listing of specific p-type arylamine-containing organic photoconductors includes diarylamines, the particular non-polymeric triphenylamines illustrated in Klufel et al, U.S. Pat. No. 3,180,730 issued Apr. 27, 1965; the triarylamines having at least one of the aryl radicals substituted by either a vinyl radical or a vinylene radical having at least one active hydrogen-containing group as described in Brantly et al. U.S. Pat. No. 3,567,450 issued Mar. 2, 1971; the triarylamines in which at least one of the aryl radicals is substituted by an active hydrogen-containing group as described in Brantly et al U.S. Pat. No. 3,658,520 issued Apr. 25, 1972; tritolylamine; and various polymeric arylamine-containing photoconductors such as those described in Fox U.S. Pat. No. 3,240,597, issued Mar. 15, 1966 and Merrill et al U.S. Pat. No. 3,779,750, issued Dec. 18, 1973.

Among the various specific polyarylalkane photoconductor materials which may be used in accordance with the present invention are the polyarylalkane materials such as those described in Noe et al U.S. Pat. No. 3,274,000 issued Sept. 20, 1966; Wilson U.S. Pat. No. 3,542,547 issued Nov. 24, 1970; Seus et al U.S. Pat. No. 3,542,544 issued Nov. 24, 1970; Rule U.S. Pat. No. 3,615,402 issued Oct. 26, 1971; Rule U.S. Pat. No. 3,820,989 issued June 28, 1974; and *Research Disclosure,* Vol. 133, May 1975, pages 7–11, entitled "Photoconductive Composition and Elements Containing Same". Preferred polyarylalkane photoconductive materials useful in the present invention can be represented by the formula:

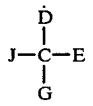

wherein D and G, which may be the same or different, represent aryl groups and J and E, which may be the same or different, represent a hydrogen atom, an alkyl group, or an aryl group, at least one of D, E and G containing an amino substituent. An especially useful polyarylalkane photoconductor which may be employed in the present invention is one having the formula noted above wherein J and E represent a hydrogen atom, an aryl group, or an alkyl group and D and G represent substituted aryl groups having as a substituent thereof a group represented by the formula:

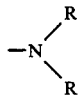

wherein R represents an unsubstituted aryl group such as phenyl or an alkyl substituted aryl such as a tolyl group. Additional information concerning the above-described preferred polyarylalkane photoconductors can be found by reference to the foregoing U.S. Patents.

A partial listing of representative p-type photoconductors useful in the present invention is presented hereinafter as follows:

1. tri-(p-tolyl)amine;
2. bis(4-diethylamino-2-meth ylphenyl)phenylmethane;
3. bis(4-diethylaminophenyl)diphenylmethane;
4. 4-(di-p-tolylamino)-4'-[4-(di-p-tolylamino)-$\beta$-styryl]-stilbene;
5. 2,3,4,5-tetraphenylpyrrole; and
6. 1,1-bis(4-di-p-tolylaminophenyl)cyclohexane.

In accord with yet another especially useful embodiment of the present invention, the polyesters described herein may be used as an additional polymeric component of a "heterogeneous" or "aggregate" multiphase photoconductive composition as described in Light U.S. Pat. No. 3,615,414 issued Oct. 26, 1971 and Gramza et al U.S. Pat. No. 3,615,396 issued Oct. 26, 1971. Such multiphase aggregate photoconductive compositions typically comprise a continuous binder phase containing dispersed therein a particulate, co-crystalline complex of (i) a pyrylium-type dye salt such as a 2,4,6-substituted thiapyrylium dye salt and (ii) a polymer having an alkylidene diarylene group in a recurring unit thereof, e.g., a bisphenol A polycarbonate. Preferably, although not required, one or more organic photoconductors are contained in solid solution with the continuous binder phase of the aggregate photoconductive composition. For detailed reference and other information concerning particular components and methods of preparation of the above-described aggregate photoconductive compositions reference may be made to the foregoing Light and Gramza et al patents hereby incorporated by reference.

In accord with yet a further embodiment of the present invention, the polyester materials described herein may be employed in a multilayer photoconductive element wherein the photoconductive composition is composed of two or more separate layers such as the "multi-active" photoconductive insulating composition described in copending Berwick et al application U.S. Ser. No. 639,039, filed Dec. 9, 1975, hereby incorporated by reference. Such "multi-active" photoconductive compositions contain a charge-generation layer in electrical contact with a charge-transport layer. The charge-generation layer of such a "multi-active" composition comprises an "aggregate" composition as described hereinabove, i.e., a composition having a continuous polymeric phase and dispersed in the continuous phase a co-crystalline complex of (1) a pyrylium-type dye salt such as a 2,4,6-substituted thiapyrylium dye salt, and (2) a polymer having an alkylidene diarylene group as a recurring unit. The charge-transport layer of such "multi-active" compositions comprises an organic photoconductive charge-transport material such as described in the aforementioned Berwick et al patent application, for example, a p-type organic photoconductor such as the arylamine, polyarylalkane and pyrrole materials noted earlier herein.

When the polyesters employed in the present invention are incorporated directly into the charge generation or charge transport layers of the above-described "multi-active" photoconductive elements, the amount of such polyester is typically within the range of from about 1 to about 40% by weight based on the total dry weight of the specific layer into which it is incorporated.

The following examples are presented to further illustrate the invention.

EXAMPLE 1

Preparation of poly(ethylene:neopentylene terephthalate 55:45)

Reaction:

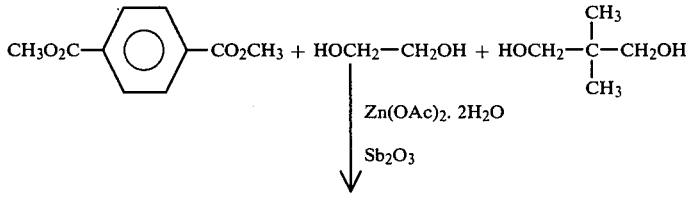

-continued

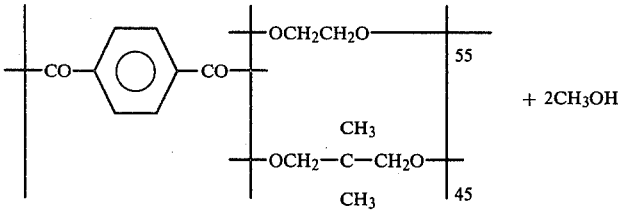

I. Materials and Equipment

A. Materials

Dimethyl terephthalate (Eastman Chemicals) 291.29 g (1.50 mole)

Ethylene glycol (Eastman Chemicals) 110.79 g (1.785 mole)

Neopentyl glycol (Eastman Chemicals) 79.67 g (0.765 mole)

Zinc acetate dihydrate (Allied Chemical Co.) 0.0687 g (65 ppm)

Antimony trioxide (J. T. Baker Chemical Co.) 0.0452 g (60 ppm)

B. Equipment 1000 ml two-neck round-bottom flask

Vigreux-claisen distillation head thermometer adapter and glass tubing stainless steel stirrer o-ring vacuum adapter short path distillation adapter and cold trap II. Procedure In a 100 ml two-neck, round-bottom flash, equipped with a Vigreux distillation head and a nitrogen inlet, were placed a mixture of 291.29 g (1.50 mole) dimethyl terephthalate, 110.79 g (1.785 mole) ethylene glycol, 79.67 g (0.765 mole) neopentyl glycol, (2,2-dimethyl 1,3-propanediol) (Note 1) 0.0687 g (65 ppm) zinc acetate dihydrate, and 0.045 g (60 ppm) antimony trioxide. Before heating and throughout the prevacuum stage, nitrogen was bubbled through the mixture by means of the inlet tube which led to the bottom of the flask. The mixture was heated at 200° C. for 16 hours during which the theoretical amount of methanol was collected. The temperature was then raised to 240° C. and held there for an additional one hour. The nitrogen inlet was replaced by a stainless steel stirrer through an o-ring adapter and the Vigreux distillation head was replaced by a short path distillation adapter and cold trap through which a very carefully controlled vacuum was applied: 5 cm Hg/min to a final vacuum of 0.05 mm Hg (Note 2). The temperature was increased to 265° C. and stirring under full vacuum was continued an additional two and one-half hours, at which point the melt became so viscous that stirring was difficult. The vacuum was released with nitrogen and the polymer was allowed to cool. The product was isolated by breaking the flask.

III. Characterization

Inherent viscosities were obtained in 1:1 (wt) phenol-chlorobenzene at 25° C. for 0.5 g/dl solutions.

Thermal transitions were obtained by differential thermal analysis at 10° C./min in nitrogen atmosphere.

Nuclear magnetic resonance spectra were obtained on a Varian T60 instrument using tetramethylsilane as an internal standard and trifluoroacetic acid as solvent. The resonance of the methyl protons of neopentyl glycol is at 1.35, the methylene protons at 4.5. The ethylene glycol protons occur 4.9 and the terephthalate protons at 8.2. The percentage of neopentyl glycol relative to ethylene glycol was calculated from the expanded (100 Hz sweep width) and integrated spectrum of the methylene region.

Typical physical properties for the polyester were measured as follows:

Inherent viscosity—0.71 dl. per gm.

Glass transition temperature—81.5° C.

Percent neopentyl glycol—42.26

IV. Notes

1. A molar ratio of 1:1.7 dimethyl terephthalate versus total glycols was used. The ratio of ethylene glycol versus neopentyl glycol was 70:30.

2. The final compositions depends markedly on the manner in which the vacuum is applied. Using the above procedure, a 0.7 excess total glycol in a 70:30 ethylene glycol versus neopentyl glycol feed ratio yields a copolymer containing about55% ethylene moieties.

EXAMPLES 2 AND 3

In a manner similar to that described above, a copolyester of isophthalic acid, terephthalic acid, cyclohexanedimethanol and ethylene glycol (Example 2) and a copolyester of terephthalic acid, isophthalic acid and ethylene glycol (Example 3) were prepared.

EXAMPLE 4

Two "multi-active" aggregate photoconductor elements were prepared. Each multi-active element had a 2.0 micron thick (dry thickness) aggregate charge generation layer coated on top of a 0.4 optical density vacuum deposited nickel layer carried on a polyester film support. On top of the aggregate charge generation layer was a 14 micron (dry) thick charge transport layer. The method of preparation of the charge generation layer used in this example was similar to that described in Example 6 of U.S. Pat. No. 3,615,415 issued Oct. 26, 1971. That is, a small portion, i.e., about 270 parts by weight, of the organic solvent coating dope (described hereinbelow) used to prepare the aggregate charge generation layer was first subjected to a 2-hour period of shearing action in a Waring Blender, and then this "preblended" portion of dope was added to the remaining aggregate coating dope, the entire dope then being subjected to a brief additional period of stirring prior to coating the dope on the nickel conductive layer of the support. The organic solvent coating dope used to prepare the aggregate charge generation layer had the following composition:

| | |
|---|---|
| High molecular weight polycarbonate | 27 parts by weight |
| 4-(4-dimethylaminophenyl)-2,6- | 3.9 parts |

-continued

| | |
|---|---|
| diphenylthiapyrylium hexafluorophosphate | by weight |
| Tritolylamine (organic photoconductive charge transport material) | 18.8 parts by weight |
| Dichloromethane (solvent) | 952 parts by weight |
| 1,1,2-trichloroethane (solvent) | 635 parts by weight |

The charge transport layer was coated from an organic solvent coating dope having the following composition:

| | |
|---|---|
| Lexan ® 145 polycarbonate (an intermediate molecular weight polycarbonate) | 180 parts by weight |
| Tritolylamine (an organic photoconductive charge transport material) | 120 parts by weight |
| Chloroform (solvent) | 1700 parts by weight |

The only difference between the two elements was that the first element (of the present invention) contained 2.7 parts by weight of the polyester of Example 1 above in the above-described organic solvent coating dope for the aggregate charge generation layer, whereas the second element (a control) contained no such additive in the charge generation layer coating dope. The addition of the polyester additive to the charge generation layer of the element of the invention did not alter the optical homogenity of the continuous binder phase of this layer in comparison to the control element. Upon subsequent testing, it was found that the charge generation layer of the control element exhibited significantly less adhesion to the conducting nickel layer than did the element of the present invention.

EXAMPLE 5

In this example a multilayer photoconductive element was prepared containing as a photoconductive composition a homogeneous organic photoconductive material containing a minor amount of the polyester material prepared as described in Example 1 above to promote adhesion of the photoconductive composition to a cellulose nitrate electrical barrier layer coated on top of a copper iodide conducting layer carried on a polyester film support. The photoconductive layer of this example had a dry thickness of approximately 7 microns and consisted of (a) 67 parts by weight of film-forming, electrically insulating polyester binder, such binder representing a polyester (outside the scope of the invention) of terephthalic acid; 2,2-bis-[β-hydroxyethoxy)phenyl]propane; and ethylene glycol, (b) 25 parts by weight of the organic photoconductor bis(4-diethylamino-2-methylphenyl)phenylmethane, (c) 3 parts by weight of a mixture of pyrylium sensitizing dyes, and (d) 8 parts by weight of the polyester as described in Example 1. The photoconductive layer of the resultant element was coated from dichloromethane organic solvent and, when dried, exhibited substantially improved adhesion to the cellulose nitrate barrier layer in contrast to a control photoconductive layer prepared as described above but without the above-described polyester component labelled (d). In addition, the photoconductive layer of the element which contained the polyester component exhibited excellent electrical operating properties nearly as good as the control without the polyester (d) component, thereby indicating the polyester had no substantial adverse effect on the electrical operating properties of the element. The addition of the polyester (d) component to the photoconductive layer did not alter the optical homogenity of this layer in comparison to the control element absent the polyester (d) component. Although the control photoconductive layer without the polyester (d) component exhibited excellent electrical properties, it exhibited poor adhesion to the underlying cellulose nitrate barrier layer in comparison to the excellent adhesion exhibited by the photoconductive layer as described above containing the polyester (d) component.

A series of additional photoconductive layers were then prepared having components (a), (b), (c) and (d) labelled above, except that the weight ratios of the (a) and (d) polyester components were varied. It was found that as the amount of the polyester (d) component began to equal and exceed the amount of the (a) component (i.e., as the polyester (d) component began to exceed more than 50% by weight of the photoconductive layer), the electrical properties of the resultant photoconductive layers deteriorated such that these layers became incapable of accepting levels of initial electrostatic charge within the normal charging range of from about 400 to 600 volts. Accordingly, as shown in this example, when the polyesters of the invention are incorporated directly into an organic photoconductive layer, it was found advantageous to use the polyester as a minor component thereof to obtain good electrical properties.

The invention has been described in detail with particular reference to certain preferred embodiments thereof, but it will be understood that variations and modifications can be effected within the spirit and scope of the invention.

What is claimed is:

1. In a multilayer photoconductive element having a photoconductive insulating composition in electrical contact with a conducting layer, the improvement wherein said element comprises, as a component of said photoconductive composition, an amorphous, water-insoluble polyester which is substantially free of any acid functions and is selected from the group consisting of (a) polyesters having recurring units derived from at least one aromatic dicarboxylic acid component and at least one diol component, at least one of said acid or diol components being a non-linear monomer selected from the group consisting of an isophthalic acid component or a branched-chain alkylenediol having the formula $$HO—CH_2—R^1—CH_2—OH$$

wherein $R^1$ is a branched-chain alkylene group having from 2 to about 15 carbon atoms, and (b) polyester copolymers having recurring units derived from at least one aromatic dicarboxylic acid component and at least one diol component, at least one of said acid or said diol components being a mixture of at least two different acids or two different diols, respectively, so that a copolyester is obtained, and at least one of said acid or one of said diol components being selected from the group consisting of a non-linear monomer as defined above or a cycloaliphatic diol; with the provisos that (1) said photoconductive insulating composition comprises a polymeric binder(s) other than said polyester so that said polyester constitutes about 1 to less than 50 percent by weight based on the total dry weight of all binders contained in said photoconductive insulating composition and is within the range of from about 1 to about 40 weight percent based on the total dry weight of said photoconductive insulating compositions; and (2) said polyester and said other polymeric binder(s) together constitute an optically homogeneous mixture of binders.

2. In a multilayer photoconductive element having a photoconductive insulating composition in electrical contact with a conducting layer, the improvement wherein said element comprises, as a component of said photoconductive composition an amorphous, water-insoluble polyester copolymer being substantially free of all acid functions and having recurring units derived from at least one aromatic dicarboxylic acid component and at least one diol component, at least one of said acid or one of said diol components being a mixture of at least two different acids or two different diols, respectively, so that a copolyester is obtained, and at least one of said acid or one of said diol components being selected from the group consisting of a non-linear monomer or a cycloaliphatic diol, said non-linear monomer selected from the group consisting of an isophthalic acid component or a branched-chain alkylenediol having the formula $$HO—CH_2—R^1—CH_2—OH$$

wherein $R^1$ is a branched-chain alkylene group having from 2 to about 15 carbon atoms; with the provisos that (1) said photoconductive insulating composition comprises a polymeric binder(s) other than said polyester so that said polyester constitutes about 1 to less than 50 percent by weight based on the toal dry weight of all binders contained in said photoconductive insulating composition and is within the range of from about 1 to about 40 weight percent based on the toal dry weight of said photoconductive insulating composition; and (2) said polyester and said other polymeric binder(s) together constitute an optically homogeneous mixture of binders.

3. In a multilayer photoconductive element as defined in claim 2, the improvement which comprises selecting as said amorphous, water-insoluble polyester copolymer a polyester having an inherent viscosity greater than about 0.4 and containing repeating copolyester units representing each of the following structural formulas:

$$\begin{array}{c} \overset{O}{\overset{\|}{\leftarrow C}}—Ar—\overset{O}{\overset{\|}{C}}\rightarrow \\ \leftarrow OCH_2R^1CH_2O\rightarrow \\ \leftarrow OCH_2R^3—O\rightarrow \end{array}$$

wherein Ar represents an aromatic moiety, $R^1$ represents branched-chain alkylene group having from 2 to about 15 carbon atoms and $R^3$ represents a straight-chain alkylene group having from 1 to about 10 carbon atoms.

4. In a multilayer photoconductive element as defined in claim 2, the improvement wherein said polyester is a member selected from the group consisting of (a) a copolyester of terephthalate acid, ethylene glycol, and neopentyl glycol;

(b) a copolyester of terephthalic acid, isophthalic acid, cyclohexanedimethanol, and ethylene glycol; and (c) a copolyester of terephthalic acid, isophthalic acid, and ethylene glycol.

5. A multilayer photoconductive element having an optically homogeneous organic photoconductive insulating composition in electrical contact with a conducting layer, said element comprising, as a component of said photoconductive composition, an amorphous, water-insoluble polyester copolymer being substantially free of any acid functions and containing repeating units represented by each of the following structural formulas:

$$\begin{array}{c} \overset{O}{\overset{\|}{\leftarrow C}}—Ar—\overset{O}{\overset{\|}{C}}\rightarrow \\ \leftarrow OCH_2R^1CH_2O\rightarrow \\ \leftarrow OCH_2R^3—O\rightarrow \end{array}$$

wherein Ar represents an aromatic moiety, $R^1$ represents branched-chain alkylene group having from 2 to about 15 carbon atoms and $R^3$ represents a straight-chain alkylene group having from 1 to about 10 carbon atoms; with the proviso that said homogeneous photoconductive composition comprises a polymeric binder(s) other than said polyester so that said polyester constitutes about 1 to less than 50 percent by weight based on the toal dry weight of all binders contained in said homogeneous photoconductive insulating composition and is within the range of from about 1 to 40 weight percent based on the toal dry weight of said homogeneous photoconductive composition.

6. A multilayer photoconductive element as defined in claim 5, wherein said polyester is a copolyester of terephthalic acid, ethylene glycol; and neopentyl glycol and has an inherent viscosity greater than about 0.4.

7. A multilayer photoconductive element having an optically homogeneous organic photoconductive insulating composition in electrical contact with a conducting layer, said element comprising, as a component of said photoconductive composition, an amorphous, water-insoluble polyester copolymer being substantially free of any acid functions and containing repeating units represented by each of the following structural formulas:

$$\begin{array}{c} \overset{O}{\overset{\|}{\leftarrow C}}—Ar—\overset{O}{\overset{\|}{C}}\rightarrow \\ \leftarrow OCH_2R^1CH_2O\rightarrow \\ \leftarrow OCH_2R^3—O\rightarrow \end{array}$$

wherein Ar represents an aromatic moiety, $R^1$ represents branched chain alkylene group having from 2 to about 15 carbon atoms and $R^3$ represents a straight-chain alkylene group having from 1 to about 10 carbon atoms; with the provisos that (1) said homogeneous photoconductive composition comprises a polymeric binder(s) other than said polyester so that said polyester constitutes about 1 to less than 50 percent by weight based on the total dry weight of all binders contained in said homogeneous photoconductive insulating composition and is within the range of from about 1 to 40 weight percent based on the total dry weight of said homogeneous photoconductive composition; and (2)

said polyester and said other polymeric binder(s) together constitute an optically homogeneous mixture of binders.

8. A multilayer photoconductive element as defined in claim 7, wherein said polyester is a copolyester of terephthalic acid, ethylene glycol, and neopentyl glycol and has an inherent viscosity greater than about 0.4.

9. A multilayer photoconductive element having a multiphase aggregate photoconductive composition in electrical contact with a conducting layer, said element comprising, as a component of said photoconductive composition, an amorphous, water-insoluble polyester being substantially free of any acid functions and containing repeating units represented by each of the following structural formulas:

$$\begin{array}{c} \overset{O}{\overset{\|}{\leftarrow C}}-Ar-\overset{O}{\overset{\|}{C}}\rightarrow \\ \leftarrow OCH_2R^1CH_2O\rightarrow \\ \leftarrow OCH_2R^3-O\rightarrow \end{array}$$

wherein Ar represents an aromatic moiety, $R^1$ represents branched-chain alkylene group having from 2 to about 15 carbon atoms and $R^3$ represents a straight-chain alkylene group having from 1 to about 10 carbon atoms, with the proviso that said aggregate photoconductive composition comprises a polymeric binder(s) other than said polyester so that said polyester constitutes about 1 to less than 50 percent by weight based on the total dry weight of all binders contained in said photoconductive composition and is within the range of from about 1 to 40 weight percent based on the total dry weight of said aggregate photoconductive composition; and (2) said polyester and said other polymeric binder(s) together constitute an optically homogeneous mixture of binders.

10. A multilayer photoconductive element as defined in claim 9, wherein said polyester is a copolyester of terephthalic acid, ethylene glycol, and neopentyl glycol and has an inherent viscosity greater than about 0.4.

11. A multilayer photoconductive element having a multi-active photoconductive insulating composition, said composition having a charge generation layer containing an aggregate photoconductive material in electrical contact with a charge transport layer containing an organic photoconductor, in electrical contact with a conducting layer, said element comprising, as a component of said multi-active photoconductive composition, an amorphous, water-insoluble polyester copolymer being substantially free of any acid functions and containing repeating units represented by each of the following structural formulas:

$$\begin{array}{c} \overset{O}{\overset{\|}{\leftarrow C}}-Ar-\overset{O}{\overset{\|}{C}}\rightarrow \\ [\leftarrow OCH_2R^1CH_2O\rightarrow] \ (OCH_2R^1CH_2O) \\ \leftarrow OCH_2R^3-O\rightarrow \end{array}$$

wherein Ar represents an aromatic moiety, $R^1$ represents branched-chain alkylene group having from 2 to about 15 carbon atoms and $R^3$ represents a straight-chain alkylene group having from 1 to about 10 carbon atoms; with the proviso that said aggregate photoconductive composition comprises a polymeric binder(s) other than said polyester so that said polyester constitutes about 1 to less than 50 percent by weight based on the total dry weight of all binders contained in said photoconductive composition and is within the range of from about 1 to 40 weight percent based on the total dry weight of said aggregate photoconductive composition; and (2) said polyester and said other polymeric binder(s) together constitute an optically homogeneous mixture of binders.

12. A multilayer photoconductive element as defined in claim 11, wherein said polyester is a copolyester of terephthalic acid, ethylene glycol, and neopentyl glycol and has an inherent viscosity greater than about 0.4.

* * * * *